US005277414A

United States Patent [19]

Binnen

[11] Patent Number: 5,277,414

[45] Date of Patent: Jan. 11, 1994

[54] SEPARATOR SUCTION DEVICE FOR SHEET FEEDERS USING RUBBER-METAL BUSHINGS

[75] Inventor: Georg Binnen, Obersulm, Fed. Rep. of Germany

[73] Assignee: Koenig & Bauer Aktiengesellschaft, Wurzburg, Fed. Rep. of Germany

[21] Appl. No.: 930,434

[22] PCT Filed: Mar. 13, 1991

[86] PCT No.: PCT/DE91/00215

§ 371 Date: Sep. 22, 1992

§ 102(e) Date: Sep. 22, 1992

[87] PCT Pub. No.: WO91/14642

PCT Pub. Date: Oct. 3, 1991

[30] Foreign Application Priority Data

Mar. 22, 1990 [DE] Fed. Rep. of Germany ..... 4009175

[51] Int. Cl.[5] ..... B65H 3/08

[52] U.S. Cl. ..... 271/107; 271/90

[58] Field of Search ..... 271/11, 90, 107; 267/141, 153, 279; 403/225

[56] References Cited

U.S. PATENT DOCUMENTS

| | | | |
|---|---|---|---|
| 2,251,416 | 8/1941 | Parker | 403/225 X |
| 2,772,104 | 11/1956 | Thiry | 403/225 |
| 4,940,221 | 7/1990 | Wirz et al. | 271/107 |

FOREIGN PATENT DOCUMENTS

| | | |
|---|---|---|
| 0321720 | 11/1988 | European Pat. Off. . |
| 2608553 | 3/1976 | Fed. Rep. of Germany . |
| 3327817 | 8/1983 | Fed. Rep. of Germany . |
| 3634659 | 10/1986 | Fed. Rep. of Germany . |
| 142869 | 4/1979 | German Democratic Rep. . |

*Primary Examiner*—Robert P. Olszewski
*Assistant Examiner*—Boris Milef
*Attorney, Agent, or Firm*—Jones, Tullar & Cooper

[57] ABSTRACT

In a resilient lifting nozzle and tracer bearing for sheet feeders, the upward and downward oscillating movements as well as the resilient pressure of the cam roller against the cam plate are provided by rubber-metal bushings.

3 Claims, 1 Drawing Sheet

SEPARATOR SUCTION DEVICE FOR SHEET FEEDERS USING RUBBER-METAL BUSHINGS

FIELD OF THE INVENTION

The invention relates to lifting nozzle and tracer bearings for fast running sheet feeders in particular, simultaneously embodying the function of bearing and the function of resilience.

The sequential feeding of individual sheets from a stack of sheets to a sheet-processing machine, such as an offset printing press, is performed in such a way that the individual sheets are lifted by means of lifting nozzles, are transferred to the tractor nozzles and are brought into a scale-like position by the latter. During this process the tracer has a hold-down and a height sensing function of the stack to be processed,.

DESCRIPTION OF THE PRIOR ART

A separator suction device for a feeder can be found in European Patent Publication EP 03 21 720 A2, wherein a support pipe supporting a separator suction device is moved upwards and downwards by means of rods.

German Patent Publication DE 36 34 659 A1 discloses a tracer device for a sheet feeder with a tracer holder and a tracer foot. On the one hand the tracer holder is connected by means of a joint with an upper and a lower rocker, and on the other hand it is pivotable around a respectively frame-connected journal. The bearings are of the conventional type.

Known lifting nozzle and tracer bearings are embodied as sliding or rolling bearings in such a way, that they absorb the upward and downward oscillating movements. These upward and downward oscillating movements are generated by cam plates via cam rollers and corresponding levers. Because the cam rollers rest frictionally connected on the cam plates, they are pressed against the latter by pressure or torsion springs. To avoid jumping of the cam rollers at high clock frequencies, they have to be pressed against the cam plates with great force, which results in high wear of the cam plates and in the danger of breakage of springs. On account of the fairly high clock frequencies of sheet feeders, the direction of rotation of the rotating parts in the rolling bearings must be reversed correspondingly often. These very fast directional changes place high acceleration forces on the rotating parts provided in the bearing and worsen the lubricant supply to the latter so that the bearings tend to form nicks.

SUMMARY OF THE INVENTION

It is therefore the object of the present invention to improve a lifting nozzle and tracer bearing for sheet feeders of the previously mentioned type by simple means in such a way that a long service life and high clock frequencies can be achieved.

This object is attained in accordance with the invention in that rubber-metal bushings are used as bearings, which absorb the upward and downward oscillating movements and take over the resilient pressing of the cam roller against the cam plate as well.

Bushings of this type are bearing elements consisting of an inner and an outer sleeve, which are firmly connected with each other by means of a resiliently deformable mass. Rubber-metal bushings of this type can be stressed for torsion and act resiliently in both torsional directions. Such rubber-metal bushings are known to be structural elements, they have a damping effect on oscillations and are free of maintenance and wear.

Thus the invention is based on the knowledge that it is possible to construct sheet feeders using such rubber-metal bushings which reduce the oscillations occurring at high clock frequencies and permit oscillating movements free of wear and maintenance without any lubrication. Because of pre-stressing of the rubber-metal bushings, an additional spring for pressing the cam roller against the cam plate can be omitted. Thus the rubber-metal bushing acts as bearing, spring and damping element. Clock frequencies of the lifting nozzles and the tracer of more then 18,000 up-and-down movements per hour have been realized in fast running sheet feeders equipped with such a resilient bearing. Further characteristics and advantages of the invention ensue from the further characteristics recited in the claims as well from the exemplary embodiments below.

BRIEF DESCRIPTION OF THE DRAWINGS

The invention will be described in detail and explained below by means of the exemplary embodiments shown in the drawings.

DESCRIPTION OF THE PREFERRED EMBODIMENT

Figure 1:
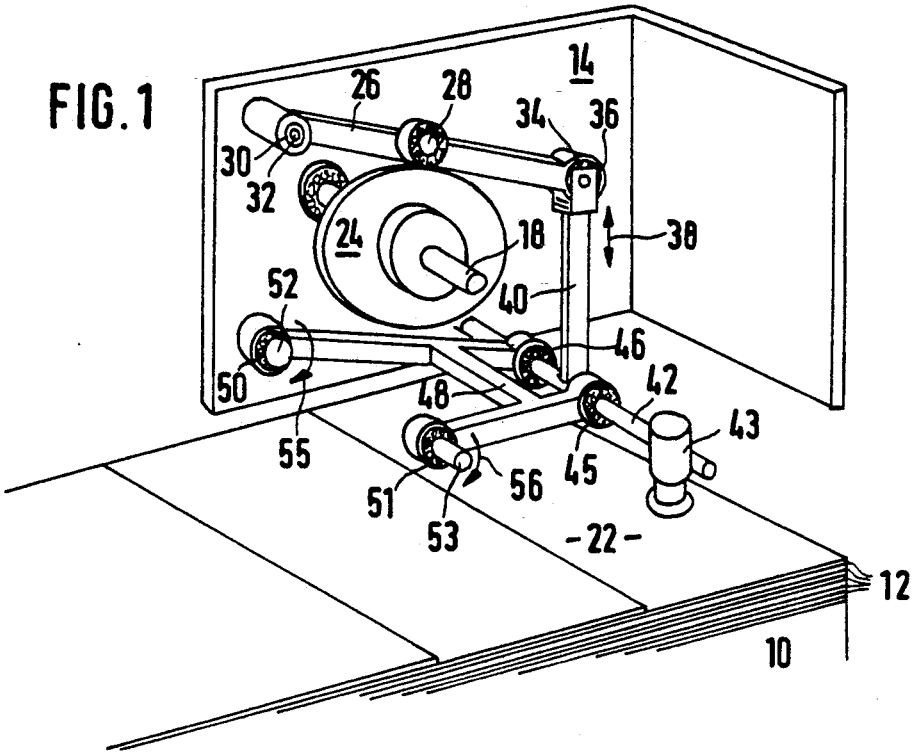
FIG. 1 is a sectional view of a separator suction system with a bearing in a schematic perspective view.
Figure 2:
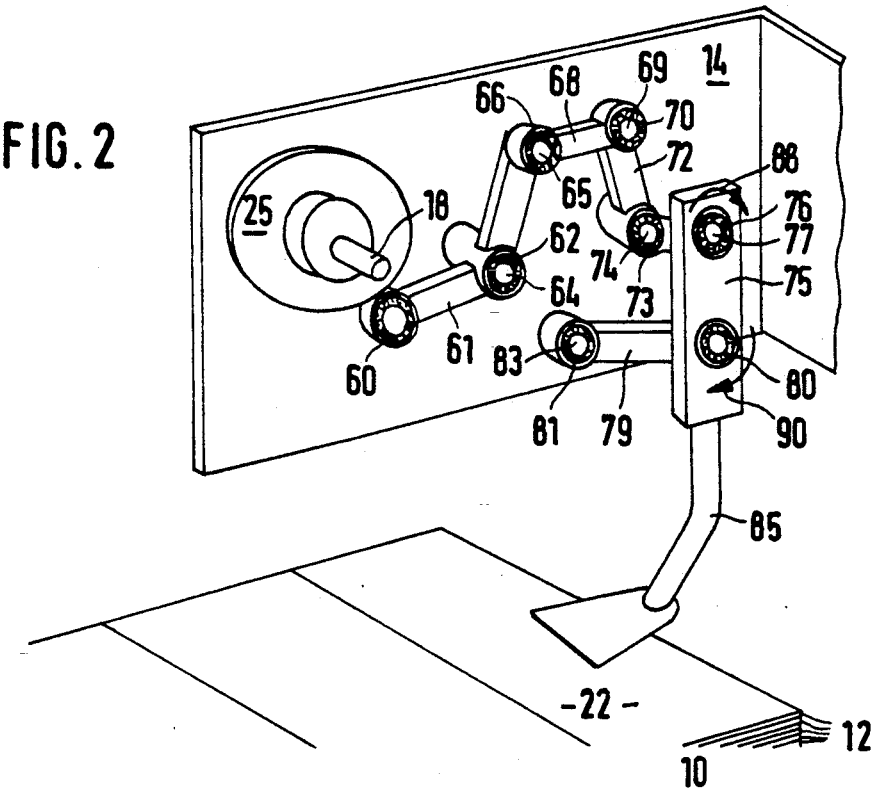
FIG. 2 is a tracer system with its bearing.

FIG. 1 and FIG. 2 show the same frame 14 of a suction head mounted above a stack 10 of sheets 12 placed on top of each other. The suction head is a part of a fast running sheet feeder, not further shown. The sheets 12 are sequentially fanned out in a scale-like manner with the aid of this sheet feeder and are fed to a sheet-processing machine, for example a sheet-fed offset printing press. A shaft 18 is seated in the frame 14 parallel above the plane 22 of the stack 10. The cam plates 24 FIG. 1 and the cam plates 25 FIG. 2 are disposed on this shaft 18 next to each other, fixed against relative rotation.

Otherwise, only the parts of the resilient lifting nozzle bearing are shown in FIG. 1, while the parts of the resilient tracer bearing are explained by FIG. 2.

Description of the resilient lifting nozzle bearing shown in FIG. 1 is as follows. The lever 26 on which the cam roller 28 is fixed is located above the cam plate 24. The lever 26 is connected with the frame 14 by means of a maintenance-free sliding bearing 30 and a bolt 32. A rubber-metal bushing 36 is seated in a receiving bore 34 at the second end of the lever 26 and passes the lifting movement 38, generated by the cam plate 24, on to the connecting rod 40. The connecting rod 40 is firmly connected with the lifting nozzle pipe 42 and gives it the required lifting movement. The lifting nozzles 43 are seated on the lifting nozzle pipe 42. To maintain the lifting nozzle pipe 42 with the lifting nozzles 43 in the required position, it is connected with the rocker 48 via two rubber-metal bushings 45 and 46, while the rocker 48 is seated on the frame 14 via two further rubber-metal bushings 50 and 51 by means of the bolts 52 and 53.

To press the cam roller 28 resiliently against the cam plate 24, the two rubber-metal bushings 50 and 51 are pre-stressed in the torsional directions 55 and 56. In this way the rocker 40, the lifting nozzle pipe 42 with the lifting nozzles 43, the connecting rod 40 and the lever 26 are resiliently pressed downward by the resilience of the two rubber-metal bushings 50 and 51 and are again pulled upward by the cam plate 24 via the cam rollers 28 and a spring-actuated upward and downward movement of the lifting nozzles 43 is thus generated.

A description of the resilient tracer bearing shown in FIG. 2 follows.

The cam roller 60, which is fastened on a two-armed lever 61, lies against the cam plate 25. The first two-armed lever 61 is fixedly seated on the frame 14 by means of a rolling bearing 62 and a bolt 64. The second end of the two-armed lever 61 is connected via a bolt 65 of a rubber-metal bushing 66 of a connecting rod 68 and a further bolt 69 of a rubber-metal bushing 70 with the second two-armed lever 72, which is seated on the frame 14 via a rolling bearing 73 by means of the bolt 74. The tracer holder 75 is seated in a rubber-metal bushing 76 and a bolt 77 on the second arm of this second two-armed lever 72. The tracer holder 75 is maintained in a vertical position by means of the lever arm 79 and the two rubber-metal bushings 80 and 81, because the bolt 83 of the rubber-metal bushing 81 is connected with the frame 14. The tracer foot 85, which is pressed on the stack 10, is fastened on the tracer holder 75.

To press the cam roller 60 against the cam plate 25, the two rubber-metal bushings 80 and 81 are pre-stressed in the torsional directions 88 and 90. In this way the lever arm 79, the tracer holder 75 and the tracer foot 85 are resiliently pressed downward.

Thus the cam roller 60 is resiliently pressed against the cam plate 25 by means of the first two-armed lever 72, the connecting rod 68 and the two-armed lever 61, because of which the controlled spring-actuated upward and downward movement of the tracer foot 85 takes place.

Installation of the rubber-metal bushings does not require exact coaxial bores and axle stubs, which considerably simplifies the production of the built-in components.

I claim:

1. A resilient lifting nozzle support assembly for a sheet feeder comprising:

a lever arm supported for pivotable motion in a side frame of a sheet feeder;

a connecting rod pivotably secured to said lever arm;

a lifting nozzle support pipe secured to said connecting rod and carrying spaced lifting nozzles;

a rocker assembly for supporting said lifting nozzle support pipe for oscillating movement;

means for driving said lever arm to effect said oscillating movement of said spaced lifting nozzles; and pre-stressed resilient rubber-metal elements supporting said rocker assembly in the side frame of the sheet feeder, said resilient rubber-metal elements being pre-stressed to press said rocker assembly, said lifting nozzle support pipe, said connecting rod and said lever arm downwardly.

2. The resilient lifting nozzle support assembly of claim 1 wherein said lever arm is connected to said connecting rod by a rubber-metal element.

3. The resilient nozzle support assembly of claim 2 wherein said rubber-metal elements are rubber-metal bushings.

* * * * *